United States Patent [19]

Lombard

[11] Patent Number: 4,492,243

[45] Date of Patent: Jan. 8, 1985

[54] COIN COUNTING AND WRAPPING DEVICE

[76] Inventor: Robert W. Lombard, 217 - 1350 Stanley Ave., Victoria, British Columbia, Canada, V8S 2S7

[21] Appl. No.: 424,603

[22] Filed: Sep. 27, 1982

[51] Int. Cl.[3] ..... G07D 9/06

[52] U.S. Cl. ..... 133/8 A

[58] Field of Search ..... 133/1 R, 1 A, 8 R, 8 A; 53/254; 33/169 R

[56] References Cited

U.S. PATENT DOCUMENTS

| | | |
|---|---|---|
| 1,171,409 | 2/1916 | Bisland . |
| 2,163,509 | 6/1939 | Bagley et al. . |
| 2,342,761 | 2/1944 | Simpson . |
| 2,637,960 | 5/1953 | Powers . |
| 2,736,478 | 2/1956 | Bernhardt, Jr. . |
| 2,794,305 | 6/1957 | Economos . |
| 3,107,467 | 10/1963 | Gates . |
| 3,710,544 | 1/1973 | Lamming . |
| 3,783,586 | 1/1974 | Dorman . |
| 3,967,435 | 7/1976 | Bergmaier . |
| 4,109,668 | 8/1978 | Malacheski . |
| 4,154,252 | 5/1979 | Elias . |

FOREIGN PATENT DOCUMENTS

| | | | |
|---|---|---|---|
| 136134 | 1/1934 | Fed. Rep. of Germany | 133/1 R |

*Primary Examiner*—Stanley H. Tollberg

*Attorney, Agent, or Firm*—Klarquist, Sparkman, Campbell, Leigh & Whinston

[57] ABSTRACT

A coin-counting and wrapping device has a base with a sloped, coin-receiving trough. A coin-counting arm is removably attached to the base and projects along the edge of the coin-counting trough, slightly above the base, to facilitate passage of a sheet of coin-wrapping material between the base and the arm. The arm bears a coin-counting scale. A coin stop is removably attached to the base and projects into the lower end of the sloped trough, slightly above the trough, to facilitate passage of the coin-wrapping material under the coin stop within the trough.

3 Claims, 5 Drawing Figures

COIN COUNTING AND WRAPPING DEVICE

FIELD OF THE INVENTION

This invention relates to devices for counting coins and facilitates subsequent wrapping, in conventional coin wrappers, of the counted coins.

BACKGROUND OF THE INVENTION

The prior art has evolved a number of devices for counting coins, for wrapping coins, or for counting and wrapping coins. Typically, these devices include a trough for holding the coins while they are counted and a cooperating scale which measures ("counts") the number of coins in the trough, thus eliminating the need for counting individual coins as they are placed in the trough. However, in existing devices of this sort, the coin counting scale is fixed with respect to the coin-receiving trough, thus restricting the device to use with coins of the particular denomination set out on the scale. The present invention provides a removable, scaled, coin-counting arm which projects along an edge of the coin-receiving trough. Since the coin-counting arm is removable a number of different coin-counting arms may be provided so that the device may be used to count and wrap coins of different denominations.

Existing coin-wrapping devices tend to provide relatively cumbersome means for positioning the coins while they are wrapped, or they require the use of preformed coin wrapping tubes. The present invention provides a unique means for positioning a sheet of conventional coin-wrapping paper relative to the counted coins and for uniformly and neatly guiding the wrapping paper around the coins as they are rolled into the wrapping paper.

By closely incorporating the features of the removable coin-counting arm with the paper positioning and guiding means, the present invention provides a device of simple, low-cost construction which may be used to count and wrap coins of various denominations in a rapid, efficient manner.

SUMMARY OF THE INVENTION

The invention provides a coin-counting and wrapping device comprising a base having a coin-receiving trough. The coin-receiving trough has a coin-supporting end surface. A coin-counting arm is attached to the base and projects along an edge of the trough. The coin-counting arm bears a scale for counting coins in the trough.

Advantageously, the coin-counting trough is sloped downward toward the coin-supporting end surface.

Preferably, the coin-counting arm is removably attached to the base and is positioned slightly above the base, to facilitate passage of a sheet of coin-wrapping material between the arm and the base.

The device may further comprise a coin stop attached to the base and projecting into the trough such that an end of the coin stop comprises the coin-supporting trough end surface and such that a gap is left between the coin stop and the trough to facilitate passage of a sheet of coin wrapping material under the coin stop in the trough. Advantageously, the coin stop is removably attached to the base.

In a particularly preferred embodiment, the device comprises a base having a sloped, coin-receiving trough; a coin-counting arm removably attached to the base and projecting along an edge of the trough, slightly above the base, to faciliate passage of a sheet of coin-wrapping material between the base and the arm; a coin-counting scale on the arm; and, a coin stop removably attached to the base and projecting into the lower end of the sloped trough, slightly above the trough, thereby facilitating passage of the sheet of coin-wrapping material under the coin stop in the trough.

Optionally, first and second scales for counting coins of first and second denominations may be placed on first and second sides of the coin-counting arm and attachment means may be provided for removably attaching the arm to the base with a selected one of the first or second sides uppermost.

DRAWINGS

DETAILED DESCRIPTION OF THE PREFERRED EMBODIMENT

Figure 1:
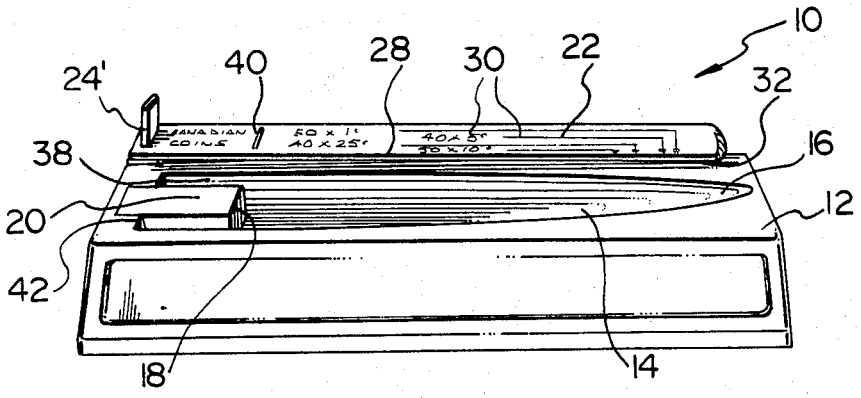
FIG. 1 is a front elevation view of a coin-counting and wrapping device according to the preferred embodiment.

In the drawings, the preferred coin-counting and wrapping device is generally designated 10. Device 10 has a base 12 which, like all parts of the device, may be injection moulded from high impact plastic. A coin-receiving trough 14 is formed in the upper surface of base 12. Trough 14 slopes from an open end 16 downward toward a coin-supporting end surface which, in the preferred embodiment, is provided by end 18 of coin stop 20.

Coin counting arm 22 is removably attached to base 12 by pressing or "snapping" lug 24 firmly into base aperture 26 so that arm 22 projects along trough edge 28. Arm 22 bears a coin-counting scale comprising indicia 30. When "snapped" into position on base 12, coin-counting arm 22 is positioned slightly above base 12, leaving a gap 32 which facilitates passage of a sheet of conventional coin-wrapping paper "W" between arm 22 and base 12.

Optionally, a second lug 24' may be placed on arm 22, opposite the side of arm 22 which receives lug 24. The second lug 24' facilites removable attachment of arm 22 to base 12 with either side of the arm facing "up". Thus, first and second coin-counting scales for counting coins of first and second denominations may be placed on each of the two sides of arm 22. For example, a "first" scale for counting Canadian coins could be placed on the "first" side of arm 22 to which lug 24 is affixed, and a "second" scale for counting United States coins could be placed on the "second" side of arm 22 to which lug 24' is affixed. To use device 10 with United States coins, the user would remove arm 22 from base 12 by pulling lug 24 free of aperture 26, turn the arm over and then press or "snap" lug 24' into aperture 26 so that the coin-counting scale bearing indicia for counting U.S. coins faces "up".

Figure 2:
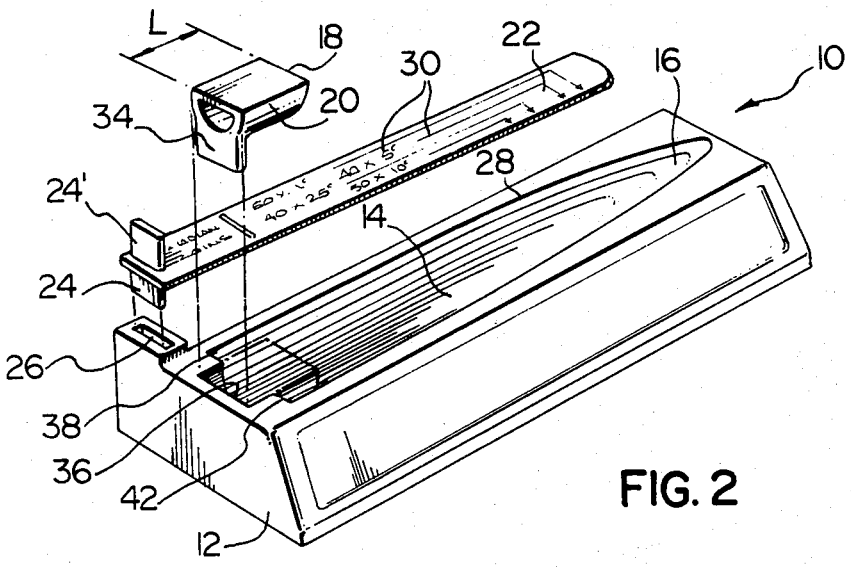
FIG. 2 is an exploded pictorial view of the device in FIG. 1.

Although coin stop 20 need not necessarily be removable from base 12, some advantages result if the coin stop is removable. For example, it has been found easier to injection mould coin stop 20 as a separate piece apart from base 12. A further advantage of a removable coin stop is that coin stops of different sizes may be interchangeably used with base 12. It might, for example, be desirable to shorten the length "L" of coin stop 20 (see FIG. 2) if device 10 is to be used with particularly thick coins, since this would enable placement of more coins in trough 14. Thus, in the preferred embodiment, coin stop 20 is removably attached to base 12. This is accomplished by firmly pressing or "snapping" coin stop lug 34 into base aperture 36 so that coin stop 20 assumes the position shown in FIG. 1.

When attached to base 12, coin stop 20 projects into trough 14, but does not contact the surface of trough 14. Thus, a gap 38 is left between coin stop 20 and trough 14 to facilitate passage of coin-wrapping paper "W" in trough 14 under coin stop 20.

A plurality of counting arms 22 may be provided with device 10, each counting arm bearing a different scale (or pair of scales if optional lugs 24' are provided) for use with coins of different denominations. In some cases it may be desirable to provide a plurality of coin stops of different sizes for use with different associated coin-counting arms bearing scales for counting relatively thick coins.

Figure 3:
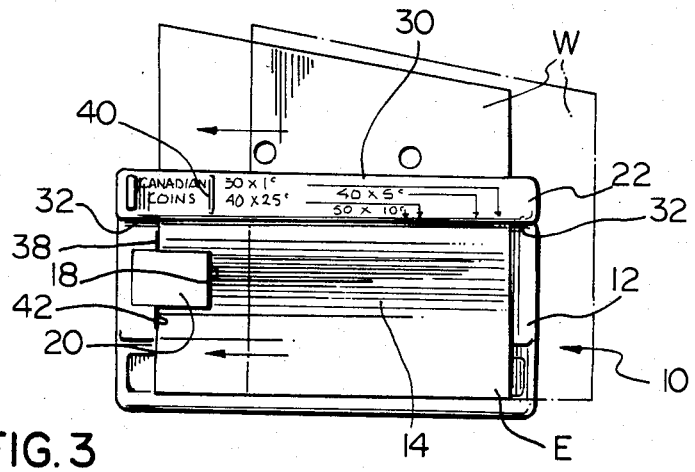
FIG. 3 illustrates the proper positioning of a sheet of coin-wrapping paper on the device of FIGS. 1 and 2, prior to the coin-counting operation.

In operation, a coin-counting arm having a scale for counting coins of the desired denomination is selected and pressed into position on base 12. If necessary, an appropriate associated coin stop is selected and pressed into position on base 12. Coin stop end 18 should line up with the "zero" mark 40 on coin-counting arm 22. An edge of coin-wrapping paper "W" is fed into gap 32, with the outer surface of paper "W" downward. Wrapping paper "W" is then fed along gap 32 toward coin stop 20. When coin stop 20 is reached, wrapping paper "W" is pressed into trough 14 and its edge is guided into gap 38. Wrapping paper "W" is then fed along gap 38 underneath coin stop 20 until the wrapping paper edge contacts end wall 42 of base 12. FIG. 3 shows wrapping paper "W" properly positioned on device 10 prior to the coin counting operation.

Figure 4:
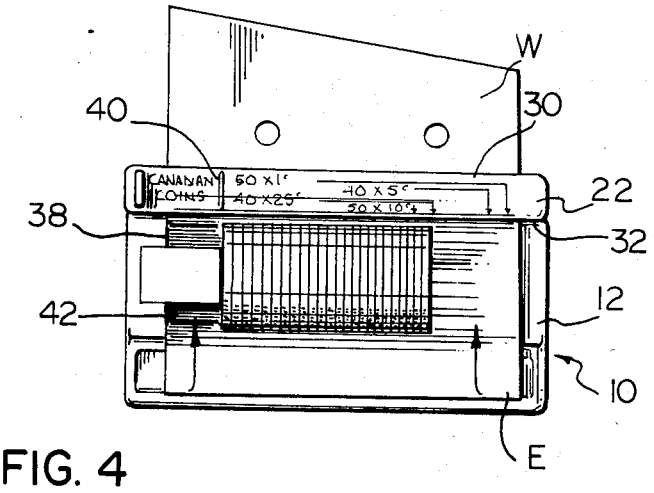
FIG. 4 illustrates placement of the coins upon the coin-wrapping paper prior to the coin-rolling operation.

After wrapping paper "W" has been properly positioned as described above, coins are placed in trough 14 end on end against coin stop 20 as shown in FIG. 4. Since trough 14 slopes downward toward coin stop end 18, the coins are urged toward coin stop end 18 and tend to remain in position rather than toppling over. Sufficient coins are positioned in trough 14 to produce a standard "roll" of the particular denomination of coin being counted. (For example, there are 50 Canadian pennies in a standard 50¢ roll of Canadian pennies, 40 Canadian nickels in a standard $2 roll of Canadian nickels, 50 Canadian dimes in a standard $5 roll of Canadian dimes and 40 Canadian quarters in a standard $10 roll of Canadian quarters.) Indicia 30 on coin-counting arm 22 obviate the need to count individual coins as they are placed in trough 14. Instead, one need only fill the trough with coins until the coins positioned in the trough extend from "zero" mark 40 to the scale pointer for the particular denomination of coin being counted.

Figure 5:
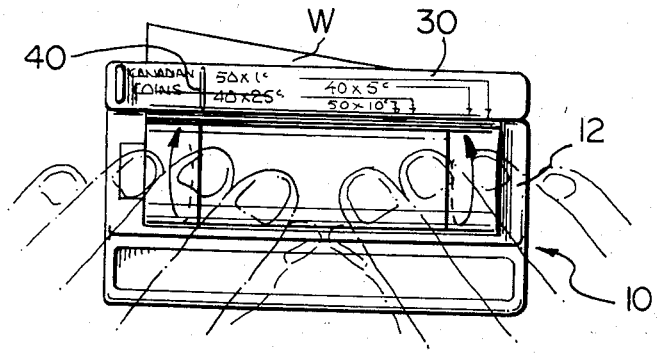
FIG. 5 illustrates the coin-rolling operation in which the coin-wrapping paper is rolled around the counted coins.

Once the correct number of coins have been positioned on wrapping paper "W" in trough 14, wrapping paper end "E" is curled over the top of the coin roll and held against the coin roll. The coin roll is then rotated in trough 14 and the fingers are used to hold wrapping paper end "E" tightly against the coin roll as shown in FIG. 5. Rotation of the coin roll in trough 14 is continued, causing wrapping paper "W" to be snugly wrapped around the coin roll. Counting arm 22 and end wall 42 hold wrapping paper "W" in alignment as it is rolled around the coins, thus ensuring that the rolled wrapping paper projects an even distance from each end of the roll of coins. Coin stop 20 serves to hold the coin roll end away from end wall 42 and inside the rolled wrapping paper. Thus, ample rolled wrapping paper is left to project beyond both ends of the rolled coins.

After wrapping paper "W" has been completely rolled around the coins the rolled wrapping paper end nearest trough open end 16 should be crimped closed over the coin roll end. The partially wrapped coin roll is then removed from the device by sliding the other wrapping paper end out from under coin stop 20 and then crimping that end closed over the coin roll end to prevent the wrapped coin roll from coming open.

Device 10 may be used with conventional coin-wrapping tubes instead of with coin-wrapping papers in sheet form. If coin-wrapping tubes are used then the coins are positioned in trough 14 without first positioning any wrapping material on the device. Once the correct number of coins is positioned in trough 14, one finger is used to press on the outer surface of the last coin (i.e. the coin which is closest to trough open end 16) and to urge the coins against coin stop 20, while slightly raising the coins from trough 14 to enable the open end of a coin wrapping tube to be slipped underneath the last coin. The finger is then removed and the tube is guided down the length of trough 14 over the coins until they all within the tube. It is helpful to hold device 10 at an angle during this operation to further assist in urging the coins against coin stop 20 and prevent them from toppling over while the coin wrapping tube is guided over the coins. The tube is then removed from the device and its ends crimped to close the tube over the coins.

As will be apparent to those skilled in the art, in the light of the foregoing disclosure, many alterations and modifications are possible in the practice of this invention without departing from the spirit or scope thereof. Accordingly, the scope of the invention is to be construed in accordance with the substance defined by the following claims.

I claim:

1. A coin-counting and wrapping device, comprising:

(a) a base having a coin-receiving trough, said trough sloping downwardly toward a coin-supporting end surface of said trough; and, (b) a coin-counting arm removably attached to said base and pojecting along an edge of said trough, slightly above said base, to facilitate passage of a sheet of coin-wrapping material between said arm and said base, said arm bearing a scale for counting coins in said trough.

2. A coin-counting and wrapping device, comprising:

(a) a base having a sloped, coin-receiving trough;

(b) a coin-counting arm removably attached to said base and projecting along an edge of said trough, slightly above said base, to facilitate passage of a sheet of coin-wrapping material between said base and said arm;

(c) a coin-counting scale on said arm; and, (d) a coin stop removably attached to said base and projecting into the lower end of said sloped trough, slightly above said trough, thereby facilitating passage of said coin-wrapping material under said coin stop in said trough.

3. A coin-counting and wrapping device as defined in claim 1 or 2, wherein said coin-counting arm has first and second sides, said first side bearing a first scale for counting coins of a first denomination; and second side bearing a second scale for counting coins of a second denomination; and further comprising attachment means for removably attaching said arm to said base with a selected one of said first or second sides uppermost.

* * * * *